US009232853B2

(12) United States Patent
Olson

(10) Patent No.: US 9,232,853 B2
(45) **Date of Patent: *Jan. 12, 2016**

(54) ORAL CARE DEVICE

(71) Applicant: Olson IP Technologies, Inc., Mundelein (IL)

(72) Inventor: Richard Carl Olson, Mundelein (IL)

(73) Assignee: Olson IP Technologies, Inc., Mundelein, IL (US)

( * ) Notice: Subject to any disclaimer, the term of this patent is extended or adjusted under 35 U.S.C. 154(b) by 204 days.

This patent is subject to a terminal disclaimer.

(21) Appl. No.: 14/018,789

(22) Filed: Sep. 5, 2013

(65) Prior Publication Data

US 2014/0000051 A1 Jan. 2, 2014

Related U.S. Application Data

(63) Continuation of application No. 12/888,240, filed on Sep. 22, 2010, now Pat. No. 8,529,150.

(60) Provisional application No. 61/277,320, filed on Sep. 23, 2009.

(51) Int. Cl.
*A46B 11/04* (2006.01)
*A46B 11/00* (2006.01)
(Continued)

(52) U.S. Cl.
CPC ..... *A46B 11/001* (2013.01); *A46B 5/02* (2013.01); *A46B 5/026* (2013.01); *A46B 9/04* (2013.01); *A46B 11/0041* (2013.01); *A46B 2200/1066* (2013.01)

(58) Field of Classification Search
CPC ..... A46B 11/001; A46B 11/0037; A46B 2200/1066
USPC ..... 401/282, 286, 171, 174; 15/167.1, 15/167.3; 433/80, 91
See application file for complete search history.

(56) References Cited

U.S. PATENT DOCUMENTS 2,241,584 A 5/1941 Cohen
2,813,290 A 11/1957 Aschenbach
(Continued)

FOREIGN PATENT DOCUMENTS

CN 2081671 7/1991
GB 2375040 6/2002
(Continued)

OTHER PUBLICATIONS

Hohlbein, Douglas J., U.S. Appl. No. 60/408,321, titled "Disposable Toothbrush," filed Sep. 5, 2002 (15 pages). cited by applicant.

*Primary Examiner* — Jennifer C Chiang
(74) *Attorney, Agent, or Firm* — Fitch Even Tabin & Flannery LLP

(57) ABSTRACT

A toothbrush device having a body defining a cavity and an input port disposed on the body in fluid communication with the cavity. The input port permits brushing by-products to pass through the input port and into the cavity while restricting passage of the brushing by-products outward from the cavity. In one form, the toothbrush device includes an elongated handle with a reservoir having at least a portion disposed within the handle. The reservoir is sized to hold a predetermined amount of oral care product, and a mouthpiece is in fluid communication with the reservoir to discharge the oral care product from the reservoir.

28 Claims, 9 Drawing Sheets

(51) Int. Cl.
*A46B 5/02* (2006.01)
*A46B 9/04* (2006.01)

(56) References Cited

U.S. PATENT DOCUMENTS

| | | | |
|---|---|---|---|
| 3,356,095 | A | 12/1967 | Tylle |
| 3,501,243 | A | 3/1970 | Heiskell |
| 4,039,261 | A | 8/1977 | Evans |
| 4,176,980 | A | 12/1979 | ONeal |
| 4,429,434 | A | 2/1984 | Sung-shan |
| 4,503,871 | A | 3/1985 | Mendenhall |
| 4,521,128 | A | 6/1985 | ONeal |
| 4,530,129 | A | 7/1985 | Labick |
| 4,588,089 | A | 5/1986 | Yanz, Jr. |
| 4,693,622 | A | 9/1987 | Booth |
| D292,447 | S | 10/1987 | Macias |
| 4,844,641 | A | 7/1989 | Grosfilley |
| 4,850,730 | A | 7/1989 | Jimenez |
| 4,865,481 | A | 9/1989 | Scales |
| 4,911,187 | A | 3/1990 | Castillo |
| 5,066,155 | A | 11/1991 | English |
| 5,074,414 | A | 12/1991 | Romana |
| 5,123,765 | A | 6/1992 | OConnell |
| 5,144,712 | A | 9/1992 | Hansel |
| 5,184,719 | A | 2/1993 | Gordon |
| 5,338,124 | A | 8/1994 | Spicer |
| 5,348,153 | A | 9/1994 | Cole |
| 5,425,591 | A | 6/1995 | Contreras |
| D361,666 | S | 8/1995 | Keane |
| 5,440,774 | A | 8/1995 | Cole |
| 5,445,825 | A | 8/1995 | Copelan |
| D368,374 | S | 4/1996 | Ashcraft |
| 5,599,126 | A | 2/1997 | Hough |
| 5,633,083 | A | 5/1997 | Iwai |
| 5,769,553 | A | 6/1998 | Chaudhri |
| 5,842,248 | A | 12/1998 | VanGrol |
| 5,851,551 | A | 12/1998 | Tseng |
| 5,893,378 | A | 4/1999 | Llerena |
| 5,898,967 | A | 5/1999 | Wu |
| 5,909,739 | A | 6/1999 | Masrour-Rad |
| 5,915,868 | A | 6/1999 | Frazell |
| 5,924,567 | A | 7/1999 | Wenum |
| 6,018,840 | A | 2/2000 | Guay |
| 6,056,466 | A | 5/2000 | Johnson |
| 6,062,233 | A | 5/2000 | Williams |
| D426,708 | S | 6/2000 | Francis |
| 6,090,488 | A | 7/2000 | Kweon |
| 6,095,157 | A | 8/2000 | Brown |
| 6,179,503 | B1 | 1/2001 | Taghavi-Khanghah |
| 6,244,777 | B1 | 6/2001 | Reid |
| 6,315,556 | B1 | 11/2001 | Stewart |
| 6,331,088 | B2 | 12/2001 | Owens |
| 6,386,779 | B1 | 5/2002 | Davis |
| 6,386,783 | B1 | 5/2002 | Spoelman |
| 6,524,023 | B2 | 2/2003 | Andersen |
| 6,648,641 | B1 | 11/2003 | Viltro |
| 6,766,549 | B2 | 7/2004 | Klupt |
| 6,964,357 | B2 | 11/2005 | Manganini |
| D528,803 | S | 9/2006 | Hohlbein |
| 7,112,003 | B2 | 9/2006 | Frison |
| D532,202 | S | 11/2006 | Hohlbein |
| D532,607 | S | 11/2006 | Hohlbein |
| 7,182,542 | B2 | 2/2007 | Hohlbein |
| 7,234,192 | B2 | 6/2007 | Barbar |
| 7,237,560 | B2 | 7/2007 | Macias |
| 7,244,073 | B2 | 7/2007 | Trocino |
| 7,246,400 | B2 | 7/2007 | Ryan |
| 7,293,318 | B1 | 11/2007 | Kuo |
| 7,311,456 | B1 | 12/2007 | Neal |
| 7,329,327 | B2 | 2/2008 | Mays |
| 7,331,731 | B2 | 2/2008 | Hohlbein |
| 7,350,526 | B2 | 4/2008 | McCabe |
| 7,399,133 | B1 | 7/2008 | Eversole |
| 7,478,959 | B2 | 1/2009 | Hohlbein |
| 7,722,274 | B2 | 5/2010 | Hohlbein |
| 7,901,153 | B1 | 3/2011 | Strider |
| 8,529,150 | B2 | 9/2013 | Olson |
| 2002/0175101 | A1 | 11/2002 | Albert |
| 2003/0086745 | A1 | 5/2003 | Micaletti |
| 2004/0016073 | A1 | 1/2004 | Knutson |
| 2004/0022576 | A1 | 2/2004 | Hoyle |
| 2007/0086831 | A1 | 4/2007 | Wold |
| 2008/0014010 | A1 | 1/2008 | Bartschi |
| 2008/0118300 | A1 | 5/2008 | Burrowes |
| 2008/0120798 | A1 | 5/2008 | Sorrentino |
| 2008/0176183 | A1 | 7/2008 | Gatzemeyer |
| 2009/0178219 | A1 | 7/2009 | Hohlbein |
| 2009/0197220 | A1* | 8/2009 | Cindrich ..... 433/216 |

FOREIGN PATENT DOCUMENTS

| | | |
|---|---|---|
| WO | 9713428 | 4/1997 |
| WO | 2004021914 | 3/2004 |

* cited by examiner

ORAL CARE DEVICE

CROSS-REFERENCE TO RELATED APPLICATIONS

This application is a continuation of U.S. patent application Ser. No. 12/888,240, filed Sep. 22, 2010, which claims the benefit of U.S. Provisional Patent Application No. 61/277,320 filed Sep. 23, 2009, which are both hereby incorporated herein by reference in their entireties.

FIELD

The field relates to brushing devices and, more particularly, to brushing devices for oral hygiene.

BACKGROUND

Toothbrushes are traditionally used by applying toothpaste to bristles of the toothbrush and brushing the toothpaste-covered bristles against one or more teeth to remove food, plaque, and bacteria therefrom. A user may occasionally spit brushing by-products into a sink during and after the brushing process. When a user is at home, a bathroom sink provides ready access to running water and a drain for disposing of the by-products. Brushing outside of the home, however, may require the user to spit the by-products onto the ground or into a waste bin for disposal.

Mouthwash may also be used for dental hygiene purposes. Like toothpaste, mouthwash may be utilized and spit into a sink for disposal. Mouthwash also presents similar disposal issues outside of the home. Spitting used mouthwash onto the ground or into a waste bin may be undesirable and awkward. Further, carrying a toothbrush, a tube of toothpaste, and a bottle of mouthwash is often impractical. These shortcomings may discourage proper dental hygiene and preclude usage on-the-go, such as after a business luncheon.

DETAILED DESCRIPTION OF THE PREFERRED EMBODIMENTS

In one aspect, a toothbrush device is provided that permits a user to rapidly and discretely brush his teeth without a sink or running water. More specifically, the toothbrush device has an elongated handle with a body that defines a cavity. The toothbrush device has an input port disposed on the body and in fluid communication with the cavity that permits the user to transfer brushing by-products from his mouth into the body cavity while restricting passage of the brushing by-products outward from the cavity. In one approach, the user generates a positive pressure against the input port and injects the brushing by-products through the input port and into the cavity. After brushing, the user may discard the toothbrush device and the brushing by-products therein. The toothbrush device may include an absorbent material within the cavity for absorbing the brushing by-products and generally trapping the by-products within the cavity.

In another aspect, a toothbrush device is provided that includes a predetermined amount of oral care product, such as mouthwash, which is highly portable and easy to use. The toothbrush device has an elongated handle and a reservoir with at least a portion of the reservoir disposed within the elongated handle. The reservoir holds the predetermined amount of oral care product, and a user may withdraw the oral care product by applying a suction force to a mouthpiece in fluid communication with the reservoir. In one approach, the mouthpiece extends from a head of the toothbrush device such that brushing and withdrawing oral care product can be accomplished without substantially changing the user's grip on the elongated handle.

Figure 1:
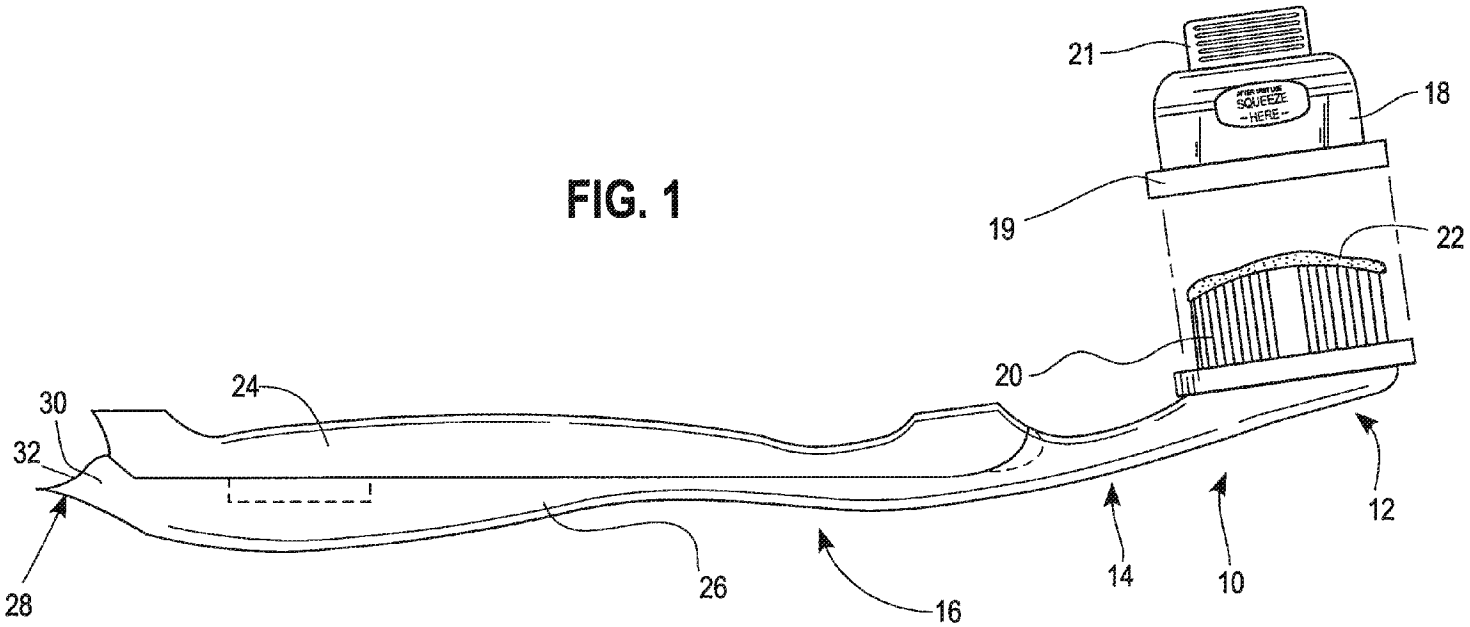
FIG. 1 is a side elevational view of a toothbrush device.
Figure 2:
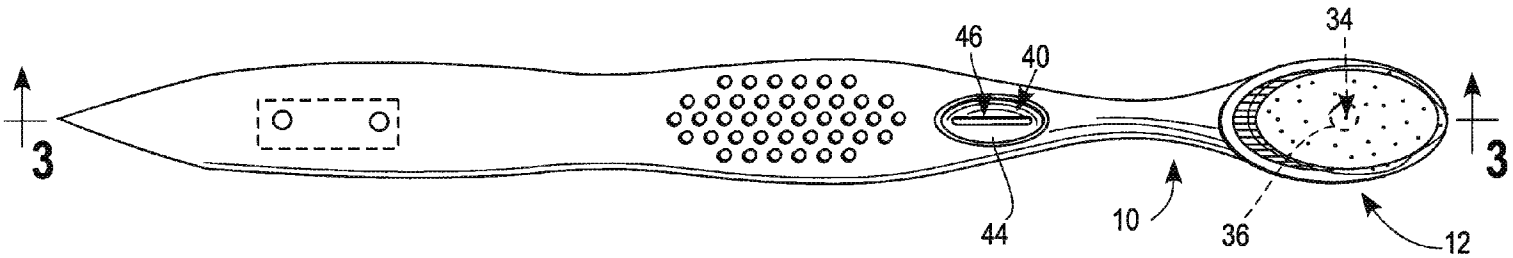
FIG. 2 is a top plan view of the toothbrush device of FIG. 1.
Figure 3:
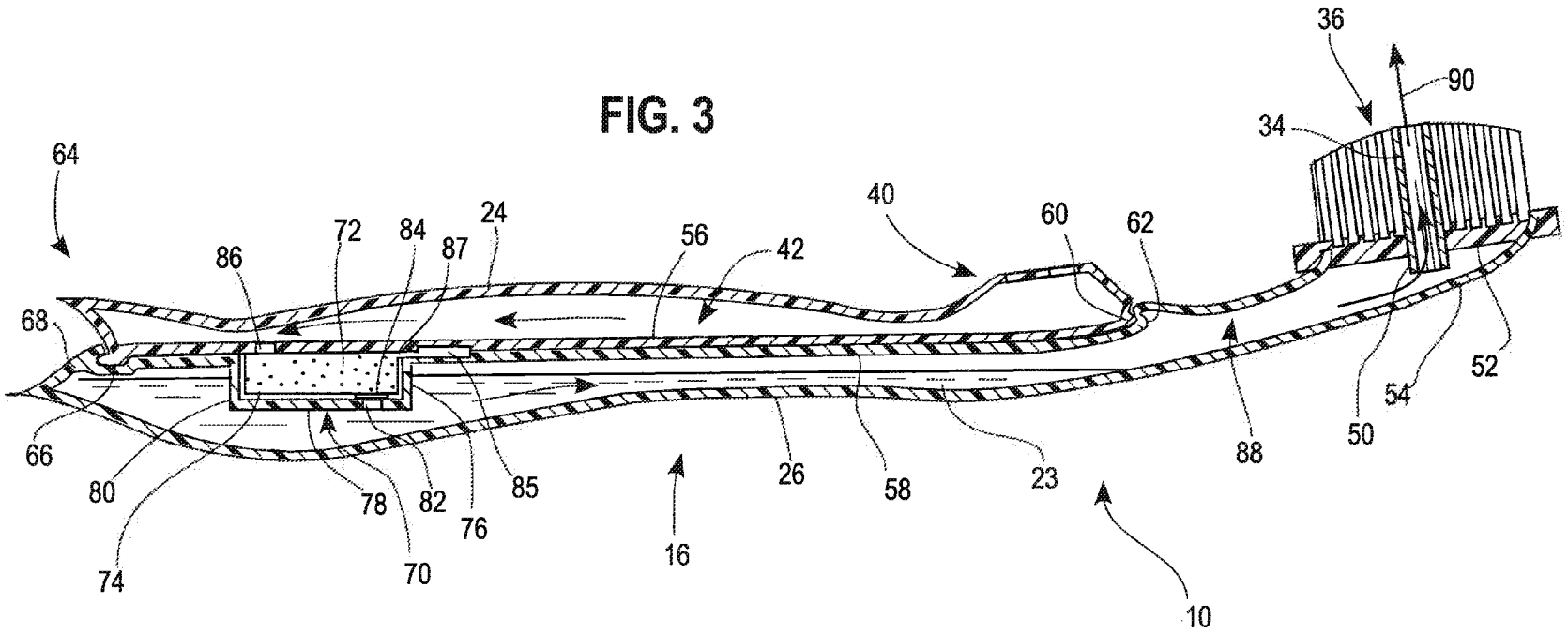
FIG. 3 is a cross-sectional view of the toothbrush device of FIG. 1 taken across line 3-3 in FIG. 2.

Turning to the figures, FIGS. 1-3 illustrate an embodiment of a toothbrush device 10 comprising a head 12, a neck 14, and a body 16. The removable cap 18 is sized to connect to the head 12 and cover a plurality of bristles 20. A user can remove the cap by removing a frangible band 19 that connects the cap 18 to the head 12 and pulling upward on a tab 21. The tab 21 can have ribs to enhance gripping. As illustrated, the tab 21 extends straight up, but alternatively, the tab could curve to either direction to form a hook configuration.

The cap 18 has toothpaste 22 therein which coats the bristles 20 when the cap 18 is connected to the head 12. Further, the bristles 20 may be re-inserted into the cap 18 during use to provide additional toothpaste 22 onto the bristles 20. In addition, the cap 18 could be made of a squeezable material so that a user can squeeze the cap to further dispense toothpaste on the bristles. The cap may be made from low density plastic to permit collapse. The body 16 comprises an upper body portion 24 and a lower body portion 26 with the upper body portion 24 being snap fit or ultrasonically welded to the lower body portion 26. The lower body portion 26 has a multi-function toothpick 28 having an edge 30 and a pick 32. As will be discussed in greater detail below, the toothbrush device 10 may provide toothbrushing capability with the plurality of bristles 20, toothpick functionality with the multi-function toothpick 28, spit receiving within the upper body portion 24, and a predetermined amount of oral care product, such as mouthwash 23, within the lower body portion 26.

Turning to FIG. 2, the toothbrush device 10 has a mouthpiece, such as a tube 34, that may be positioned on the head 12 surrounded by the plurality of bristles 20. The user may withdraw mouthwash from the lower body portion 26 by applying a vacuum to an open end 36 of the tube 34. With respect to the upper body portion 24, an input port 40 is positioned on the body 16 and is in communication with a cavity 42 within the upper body portion 24. The input port 40 may permit a user to position his mouth adjacent the input port 40 and spit brushing by-products into the cavity 42 (see FIG. 6). The input port 40 comprises a concave wall 44 surrounding a slit 46. The input port 40, however, may alternatively comprise a resilient insert, one-way valve, user-actuated valve, straw, or any configuration that generally permits brushing by-products to be passed into the cavity 42 while restricting the by-products from exiting the cavity 42.

The tube 34 extends through an opening 50 in a brush plate 52 connected to a head 54 of the lower body portion 26, as shown in FIG. 3. The body 16 of the toothbrush device 10 has a two-part configuration with a lower wall 56 of the upper body portion 24 in close relation to an upper wall 58 of the lower body portion 26. The upper body portion 24 may be connected to the lower body portion 26 by inserting a tab 60 of the upper body portion 24 below a lip 62 of the lower body portion 26 and pressing a trailing end 64 of the upper shell 24 downward such that a catch 66 of the upper body portion 24 snaps past a lip 68 of the lower body portion 26. Alternatively, the upper body portion 24 may be ultrasonically welded to the lower body portion 26. Although the lower wall 56 and the upper wall 58 are in close relation, there may be a gap spacing between the walls 56, 58 to permit airflow therebetween, as will be discussed in greater detail below.

The lower shell 26 has a sponge receptacle 70 sized to receive a rectangular sponge 72 within a cavity 74 defined by walls 76, 78, and 80. The lower wall 78 has an opening 82 that is initially obstructed by a dab of toothpaste gel 84. Similarly, the lower wall 56 of the upper body section 24 has an opening 86 that permits from airflow within the cavity 42 into the sponge cavity 74. In this manner, when a user injects brushing by-products through the input port 40, airflow associated with the by-products may pass through the cavity 42, through the opening 86, through the sponge 72, and into the discharge cavity 85. The discharge cavity 85 is open to the atmosphere between the walls 56, 58 of the upper and lower body portions 24, 26. A small passage 87 leads to the larger discharge cavity 85.

When applying a suction force to the mouthpiece 34 to withdraw the mouthwash 23 from the reservoir 88, the suction force will dislodge the gel 84 and permit airflow through the cavity 42 and into the reservoir 88 to compensate for the displacement of the mouthwash 23 from within the reservoir 88. A suction force at the mouthpiece 34 may also draw air between the walls 56, 58 and through the opening 82 before reaching the reservoir 88. Once the gel 84 is dislodged, airflow through the toothbrush device 100 may still be restricted by the sponge 72. The sponge 72 may also restrict flow of the brushing by-products into the reservoir 88 after the gel 84 has been dislodged. Conversely, the sponge 72 can restrict flow of the mouthwash 23 into the cavity 42 after the gel 84 has been dislodged.

Figure 4:
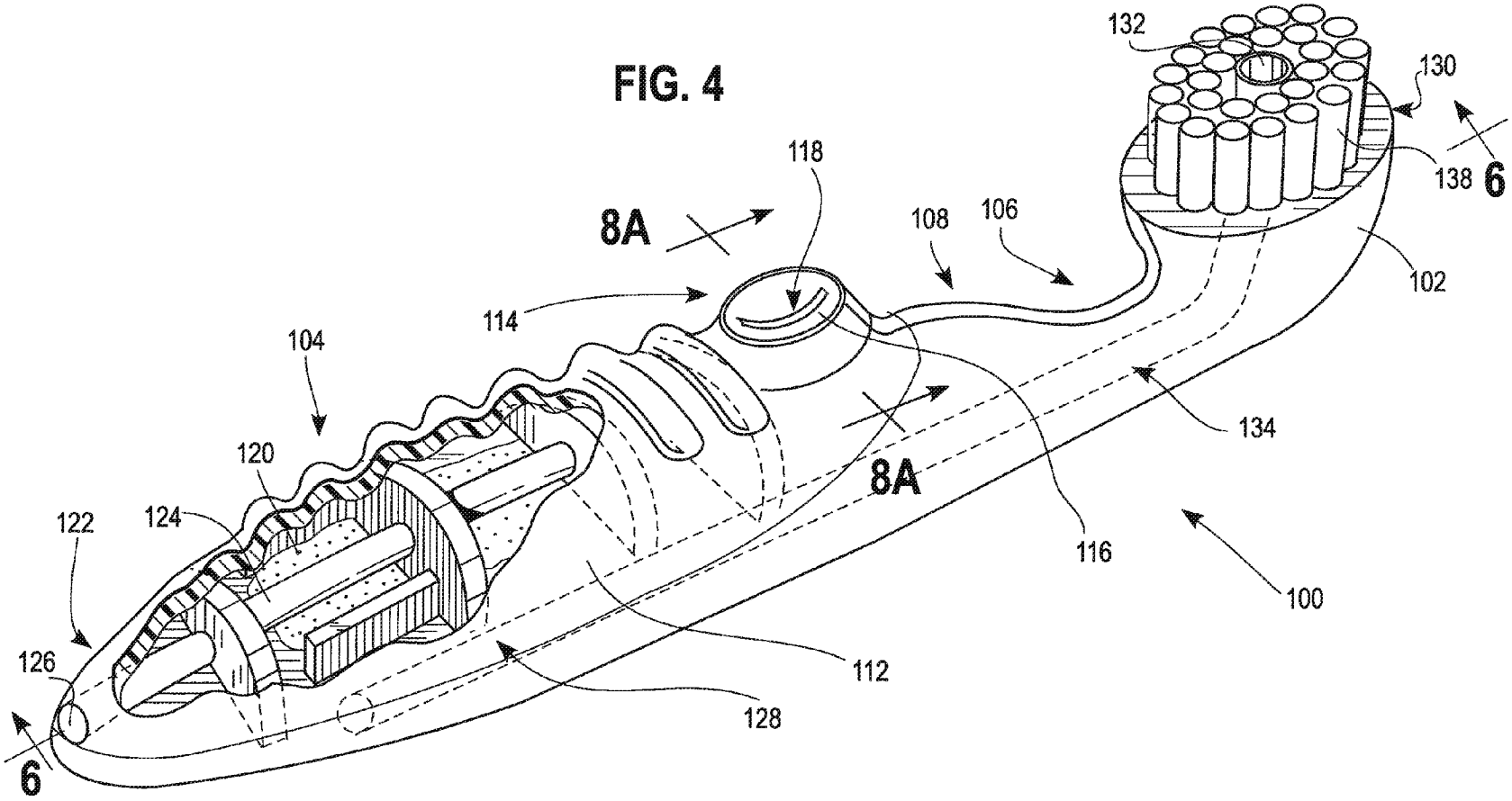
FIG. 4 is a perspective view of a toothbrush device with a portion of the toothbrush device removed to illustrate interior components of the toothbrush device.
Figure 5:
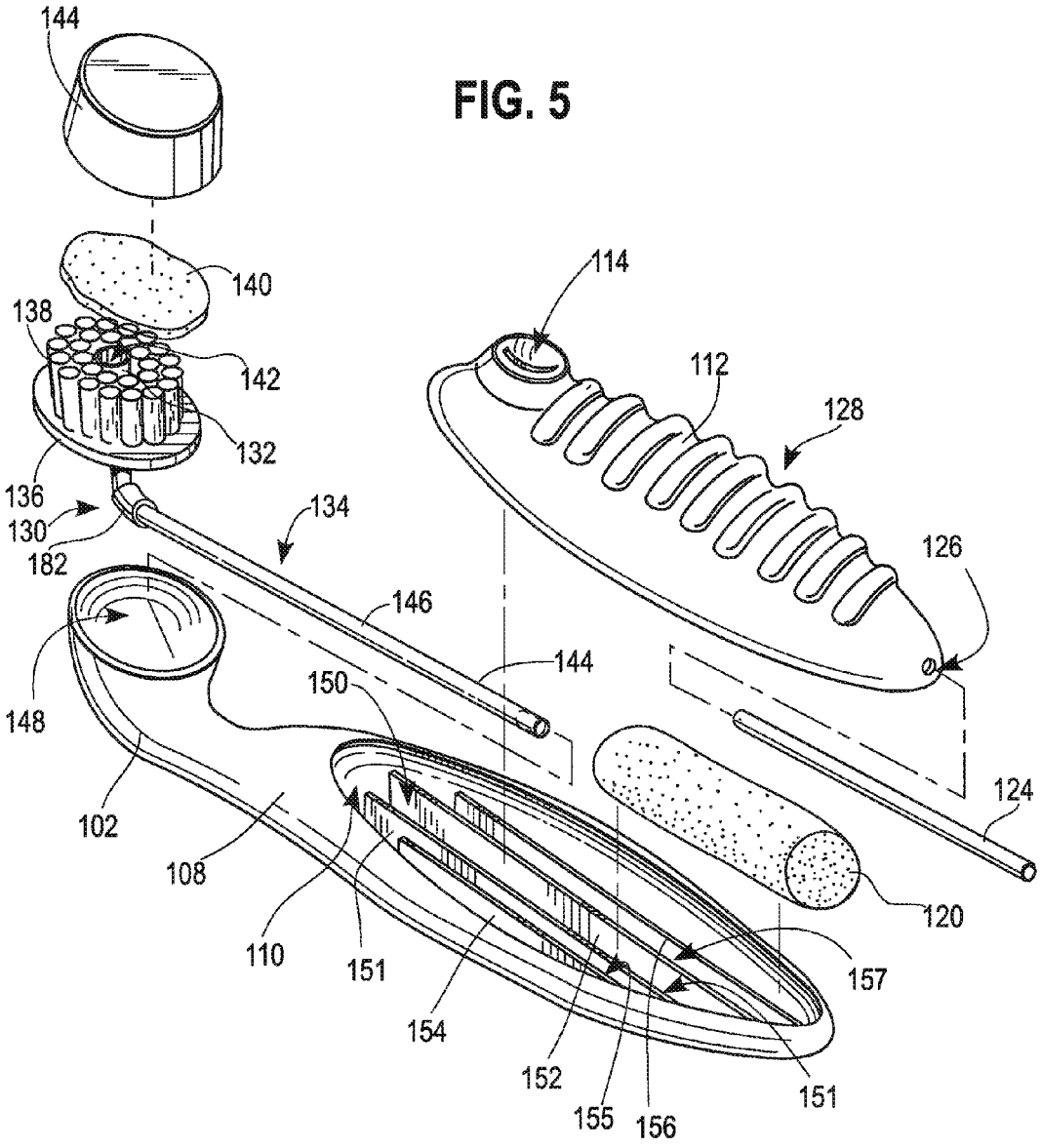
FIG. 5 is an exploded perspective view of the toothbrush device of FIG. 4.

FIGS. 4-8B illustrate another embodiment of a toothbrush device 100 having a head 102 connected to a handle 104 via a neck 106. The toothbrush device 100 has a two-part configuration comprising a body 108 that defines a cavity 110 and a cover 112 that connects to the body 108 and provides a substantially watertight closure of the cavity 110, as shown in FIGS. 4 and 5. The cover 112 may be connected to the body 108 using ultrasonic welding, snap-fit connections, or other approaches. With reference to FIG. 4, the cover 112 may include an input port 114 having a concave wall 116 that defines a longitudinal slit 118 for receiving brushing by-products. The toothbrush device 100 may also include an absorbent material 120, such as cotton material, tampon material and diaper material, to absorb brushing by-products injected into the cavity 110. To accommodate the airflow that may accompany the by-products, the toothbrush device 100 may include a vent 122. In one approach, the vent 122 comprises a vent tube 124 that carries air from the cavity 110 out an opening 126 in the cover 112. As will be discussed in greater detail below, the cover 112 and the vent tube 124 combine with other components to form a cover assembly 128 that is connected the body 108 to form the toothbrush device 100.

The toothbrush device 100 may also include a brush assembly 130 that generally includes a mouthpiece, such as a tube 132, in communication with a reservoir 134 with the tube 132 extending through a brush disc 136, as shown in FIG. 5. The reservoir 134 may contain an oral care product, such as 7 milliliters of mouthwash, to permit a user to withdraw the mouthwash using the tube 132 as desired. The brush disc 136 has a plurality of bristles 138 surrounding the tube 132. A toothpaste 140 may be applied over the tube 132 and the bristles 138 to seal an opening 142 of the tube 132. Further, a cap 144 may be connected to the head 102 of the toothbrush device 100 to enclose the tube 132, bristles 138, and toothpaste 140. To connect the brush assembly 130 with the body 108, a reservoir tube 146 of the reservoir 134 may be passed through an opening 148 in the head 102 until a handle end 149 of the reservoir tube 146 is positioned within an intermediate channel 150 between elevation members, such as ribs 151, 152.

Figure 6:
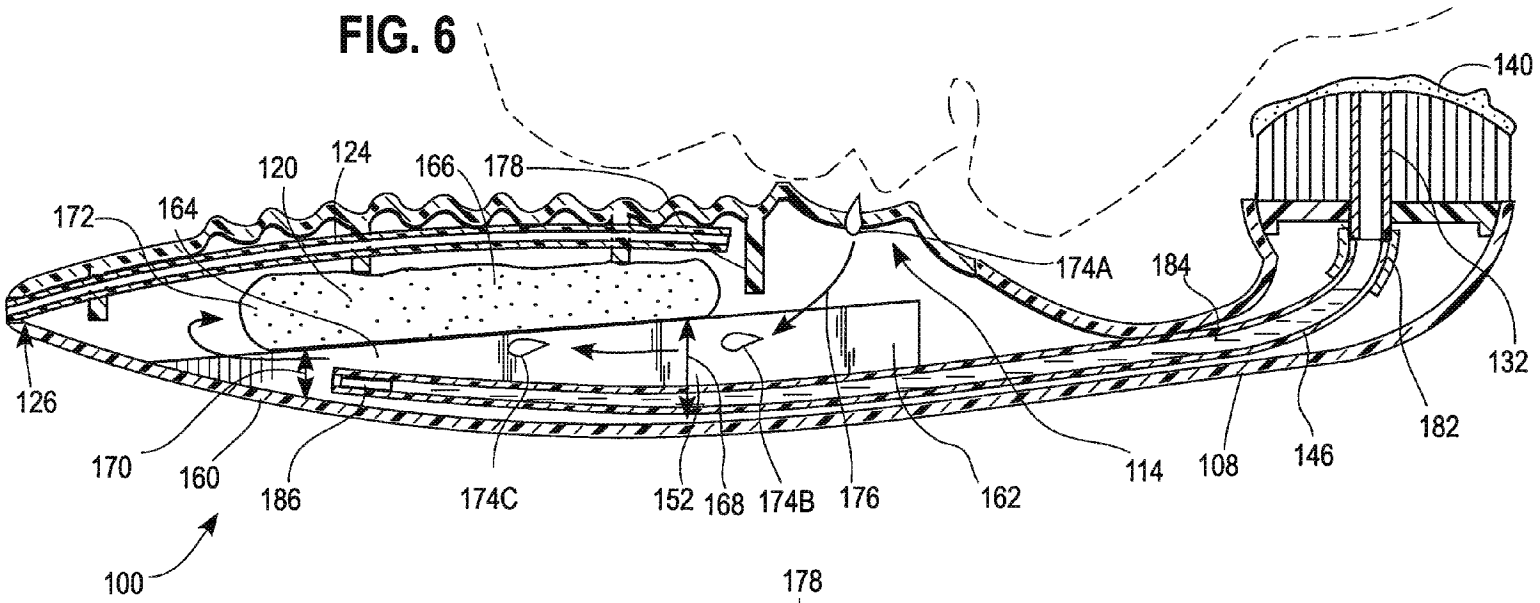
FIG. 6 is a cross-sectional elevational view of the toothbrush device of FIG. 4 taken across line 6-6 in FIG. 4 that illustrates a person using the toothbrush device.

The ribs 151, 152, in combination with outer ribs 154, 156, elevate the absorbent material 120 above a lower wall 160 of the body 108, as shown in FIG. 6. The absorbent material 120 may have a volume of approximately 1.75 cubic inches to retain brushing by-products within the cavity 110. In one embodiment, the ribs 151, 152, 154, 156 have a sloping profile where a first end 162 below the input port 114 has a greater height than a second end 164 near the vent 126. In this manner, the ribs 151, 152, 154, 156 may elevate a leading end portion 166 of the absorbent material 120 a distance 168 that is greater than a distance 170 between a trailing end portion 172 of the absorbent material 120 and the lower wall 160 of the body 108. As shown in FIG. 6, when a user injects brushing by-product 174A through the input port 114, the by-product 174A will travel downward in direction 176 toward the lower wall 160. A blocking wall 178 disposed between the input port 114 and the vent tube 124 directs the by-product 174B away from the leading end portion 166 of the absorbent material 120. Further, channels 150, 155, 157 (FIG. 5) between the ribs 151, 152, 154, 156 provide pathways for the by-products 174 to travel beneath the absorbent material 120.

In one aspect, directing the by-product 174B away from the leading end portion 166 and below the absorbent material 120 limits the exposure of the leading end portion 166 to the by-product 174B and reduces the risk of the leading end portion 166 swelling and acting as dam to restrict flow of the by-product 174B. A damming action of the leading end portion 166 would obstruct the by-product 174B from passing beyond the leading end portion 166 and into contact with the trailing end portion 172. This would reduce the overall absorption capacity of the absorbent material 120. After the by-product 174C has passed below the blocking wall 178, the by-product 174C travels below the absorbent material 120 and is eventually redirected by the lower wall 1160 into contact with the trailing end portion 172 of the absorbent material 120.

With continued reference to FIG. 6, the brush assembly 130 is also illustrated. More particularly, the cross-sectional view of FIG. 6 illustrates a fluid transfer fitting, such as elbow 182, connecting the tube 132 to the reservoir tube 146 such that an oral care product, such as mouthwash 184, can be drawn from the reservoir tube 146. In this embodiment, the reservoir 134 includes a piston 186 configured to translate within the reservoir tube 146 in response to suction being applied to the tube 132. Further, suction applied to the tube 132 tends to draw the mouthwash 184 and the piston 186 through the reservoir tube 186 toward the tube 132.

Figure 7:
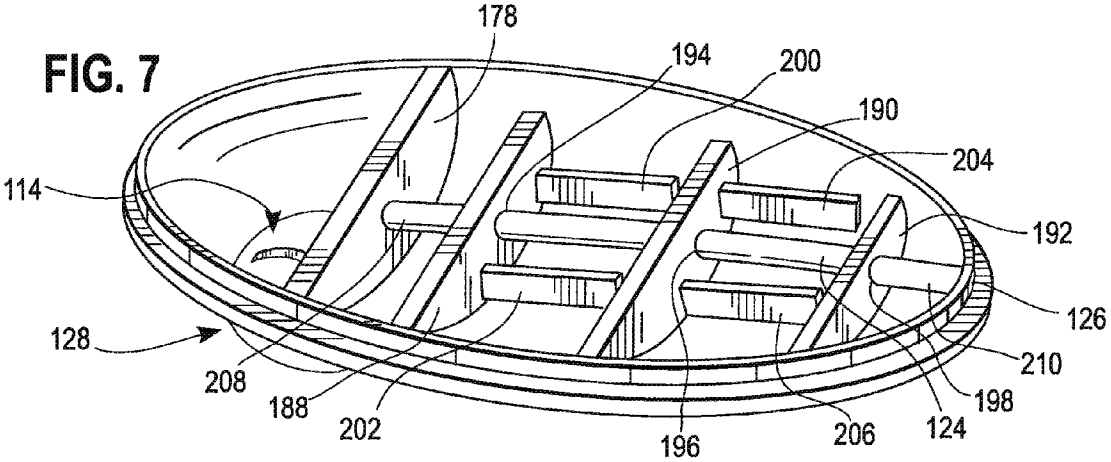
FIG. 7 is a perspective view of a cover assembly of the toothbrush device of FIG. 4.

The underside of the cover assembly 128 includes the blocking wall 178 and one or more transverse guide walls 188, 190, 192 having openings 194, 196, 198, respectively, which are sized to receive the vent tube 124, as shown in FIG. 7. The cover assembly 128 may also include longitudinal guide walls 200, 202, 204, and 206 that may resist transverse movement of the absorbent material 120. The longitudinal guide walls 200, 202, 204, and 206 may also press against the absorbent material 120 and form longitudinal depressions in the absorbent material 120 that channel the brushing by-products toward the leading end portion 166 of the absorbent material 120.

With reference to FIGS. 6 and 7, the vent tube 124 has a distal end portion 208 separated from the blocking wall 178 by a gap spacing. At the other end of the vent tube 124, a proximal end portion 210 extends through the opening 126. The gap spacing between the blocking wall 178 and the distal end portion 208 permits air injected into the cavity 110 via the input port 114 to enter the distal end portion 208 and travel along the vent tube 124 before exiting the toothbrush device 100 at the opening 126. In one approach, the presence of the absorbent material 120 restricts brushing by-products 174 from entering the distal end portion 208 of the vent tube 124.

Figure 8A:
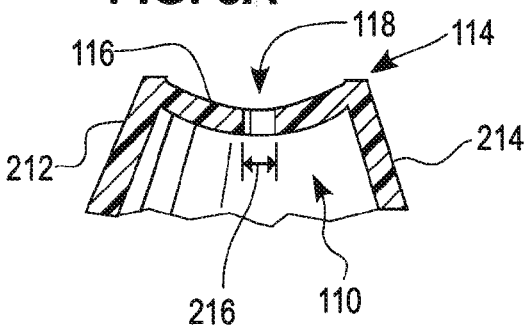
FIG. 8A is a cross-sectional elevational view of an input port of the toothbrush device of FIG. 4 taken across line 8A-8A in FIG. 4.
Figure 8B:
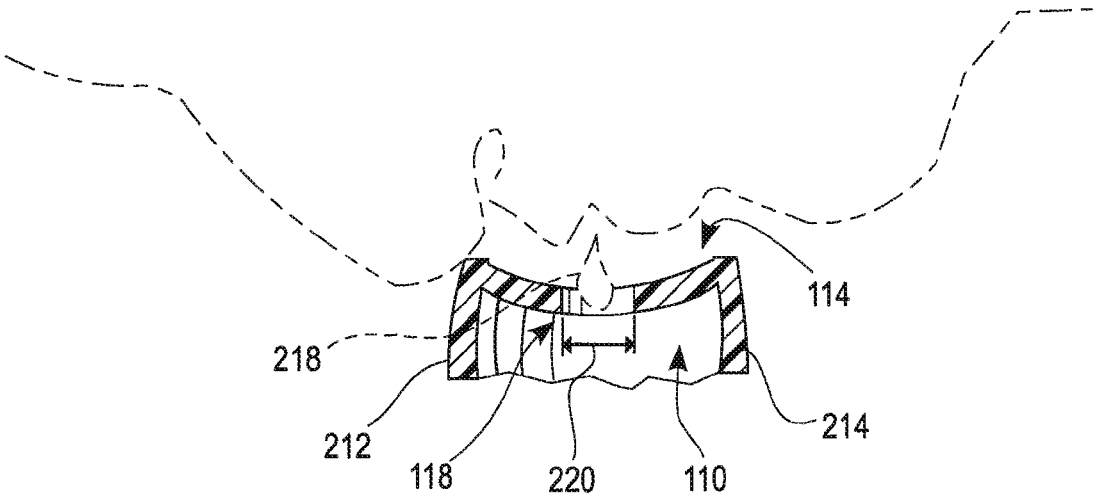
FIG. 8B is a cross-sectional view similar to FIG. 8B showing a user spitting brushing by-products through the input port.

Turning to FIGS. 8A and 8B, one embodiment of the input port 114 is shown shifting between a closed configuration (FIG. 8A) and an open configuration (FIG. 8B). More specifically, in FIG. 8A, a cross-sectional view of the input port 114 shows the concave wall 116 and extending between sidewalls 212, 214. In this closed configuration, the slit 118 has an initial width 216. In FIG. 8B, the user is generating a positive pressure against the input port 114 to inject brushing by-products 218 through the input port 114. In one approach, a user may place his or her lips on the input port 114 to form a seal which allows a greater positive pressure to be applied against the input port 114. The positive pressure may shift the input port 114 to an open configuration by deflecting the sidewalls 212, 214 and the concave wall 216 no that the slit 118 has a width 220 greater than the width 216. Once the user has stopped applying the positive pressure against the input port 114, the sidewalls 212, 214, and the concave wall 116 may resiliently return to the open configuration which reduces the width of the slit 118.

Figure 8C:
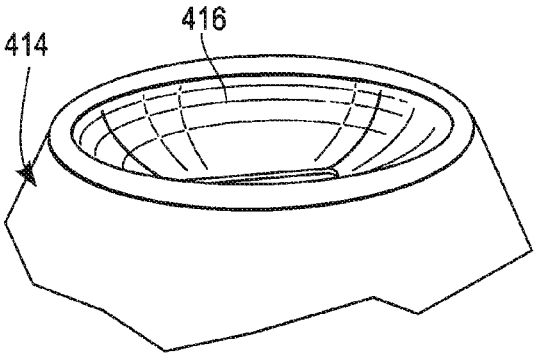
FIG. 8C is a perspective view of an alternative input port.
Figure 8D:
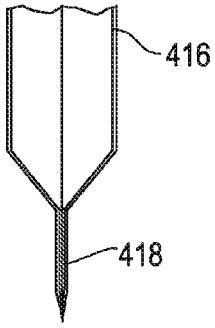
FIG. 8D is a cross-sectional view of the input port of FIG. 8C.
Figure 8D:
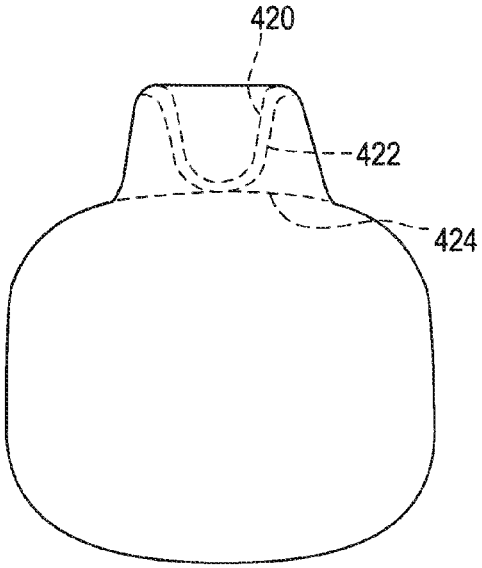
Figure 8E:
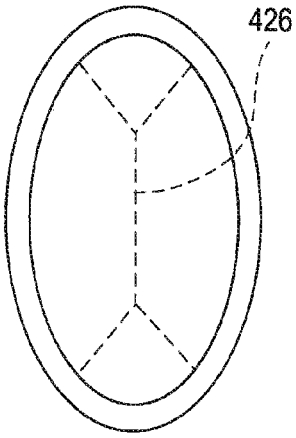
FIG. 8E is a top plan view of the input port of FIG. 8C.

In FIGS. 8C-8E, another embodiment of an inlet port 414 is shown. The inlet port 414 is initially sealed before use. The inlet port 414 has a concave well 416. A splitter tool 416 can be used to open the inlet port 414. The splitter tool 416 has a sharp end 418 that has cutting or puncture edges that cut through and puncture the well 416. In FIG. 8D, the inner line 420 shows the well wall prior to puncture, and the outer line 422 shows the well wall after puncture and illustrates the inlet port 424 formed by the tool 416. FIG. 8E illustrates the preferred pattern of the cuts through the well. The tool would have cutting edges that match up with the dashed lines 426. The arrangement creates a flapper-like valve configuration that aids in flow into the device and retards flow outward, back through the inlet port 414. The embodiments of FIGS. 8A-8E are not limited to the embodiments of the toothbrush of FIG. 4.

Figure 9:
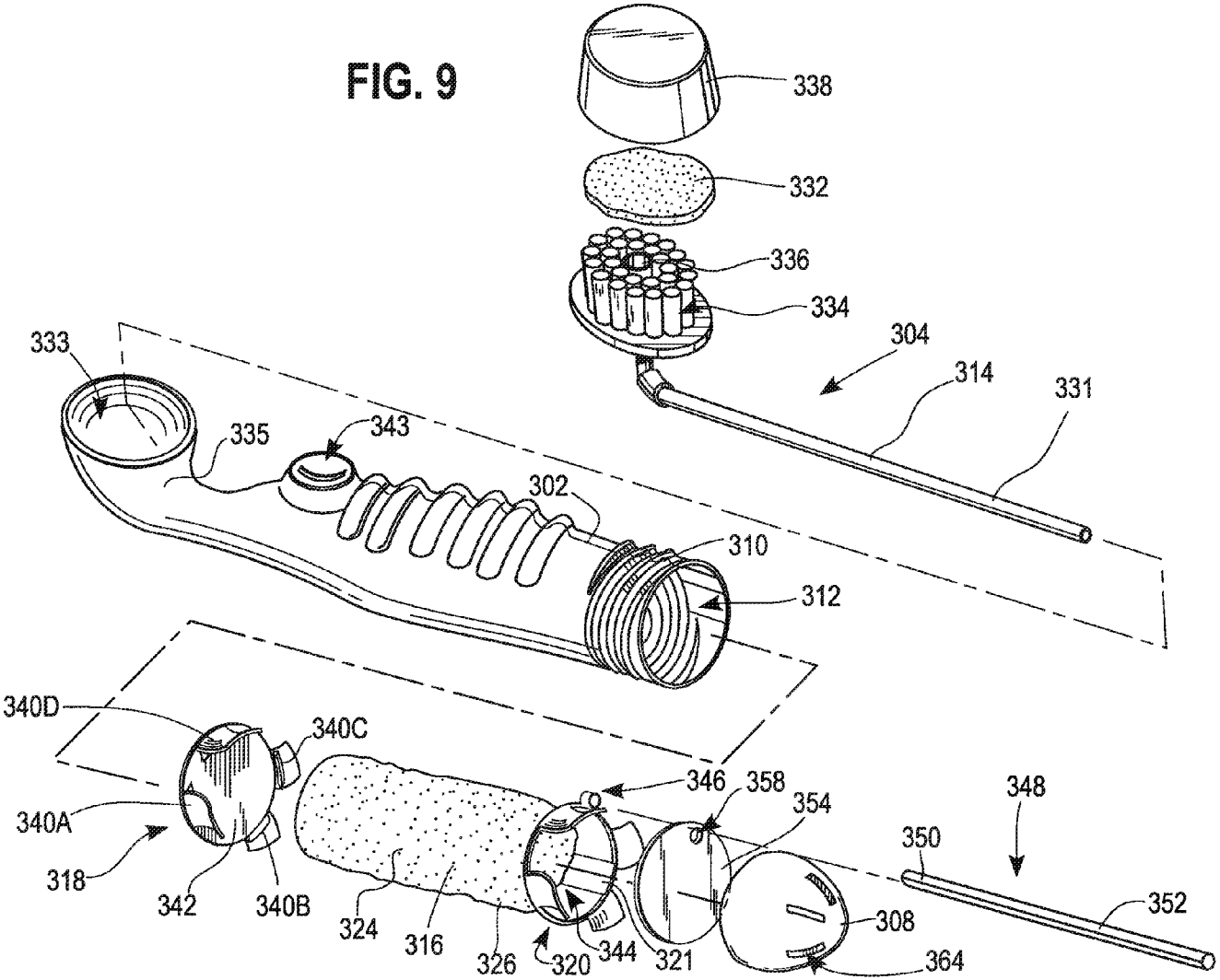
FIG. 9 is a perspective view of a toothbrush device with a portion of the toothbrush device removed to illustrate interior components of the toothbrush device.
Figure 10:
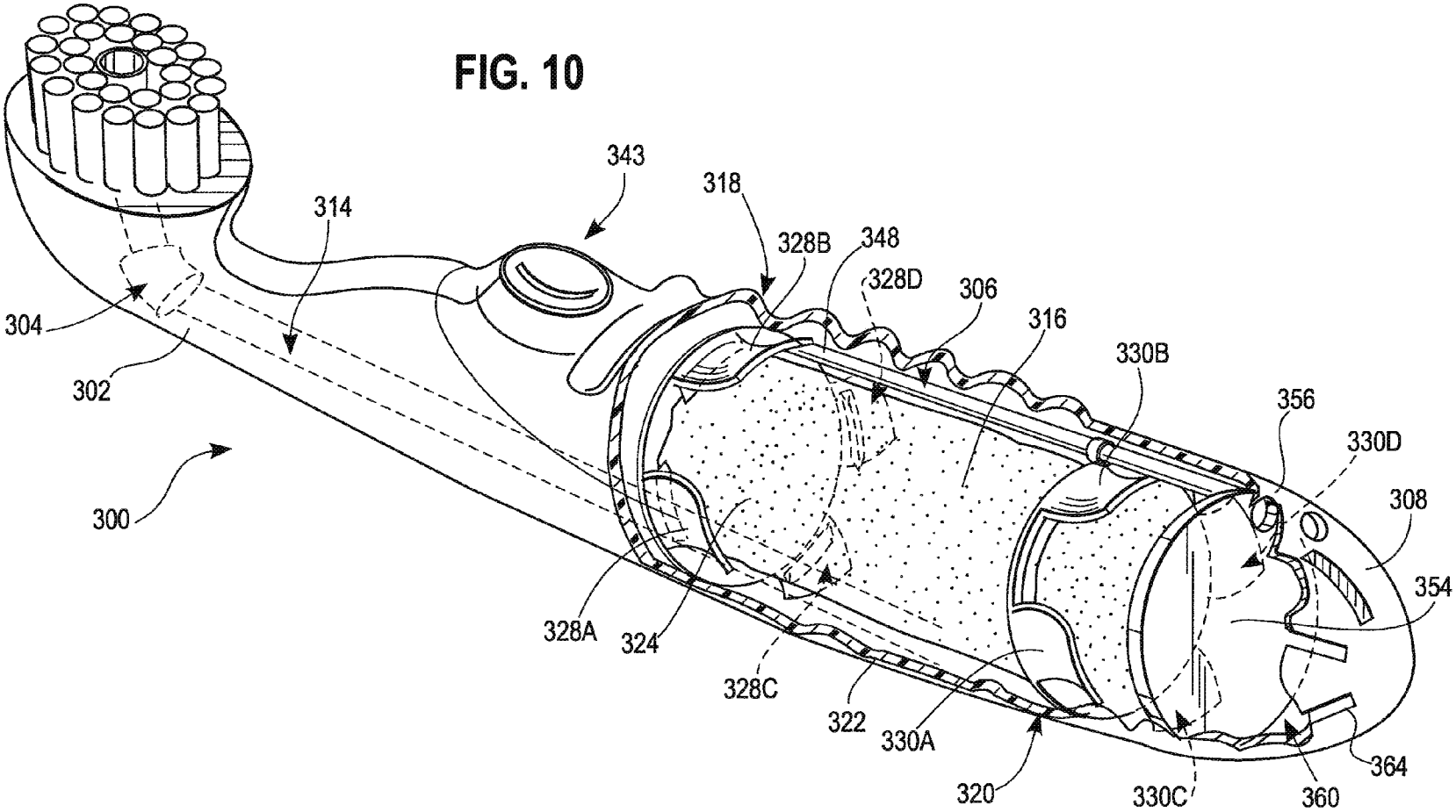
FIG. 10 is an exploded perspective view of the toothbrush device of FIG. 9.

FIGS. 9 and 10 illustrate another embodiment of a toothbrush device 300. The toothbrush device 300 includes a unitary body 302 that receives a brush assembly 304 as well as an absorbent material assembly 306. An end cap 308 is threadingly engaged with a threaded end 310 of the body 302 and can be ultrasonically welded thereto in order to retain the absorbent material assembly 306 within the body 302. In greater detail, the body 302 has a cavity 312 sized to receive both the brush assembly 304 and the absorbent material assembly 306.

The absorbent material assembly 306 includes an absorbent material, such as absorbent material 316, and front and rear harnesses 318, 320. The front and rear harnesses 318, 320 elevate the absorbent material 316 above a lower wall 322 of the body 302. In one approach, the front harness 318 elevates a leading end portion 324 of the absorbent material 316 above the lower wall 322 a distance greater than the distance the rear harness 320 elevates a trailing end portion 326 above the lower wall 322. This configuration may tend to direct brushing by-products toward the trailing end portion 326 of the absorbent material 316 and limit damming of the leading end portion 324. In one approach, both the front harness 318 and the rear harness 320 have resilient tabs 328A-328D and 330A-330B, respectively, that act to grasp the absorbent material 316 when the absorbent material assembly 306 is inserted into the cavity 312. Further, the tabs 328A-328D and 330A-330D separate the absorbent material 316 from the body 302.

To assemble the toothbrush device 300, a distal end 331 of the reservoir 314 is passed through an opening 333 in a head 335 in the body 302. Next, toothpaste 332 may be positioned on the bristles 334 and a mouthpiece, such as a tube 336, before a cap 338 is connected to the head 335 of the body 302. The front harness 318 may then be pressed onto the leading end portion 324 of the absorbent material 316 with the teeth 340A-340D engaging the leading end portion 324. Further, the leading end portion 324 may abut a blocking wall 342 of the front harness 318. The blocking wall 342 may direct brushing by-products injected through an input port 343 downward below the absorbent material 316 to avoid damming of the leading end portion 324 of the absorbent material 316. The rear harness 320 may then be passed over or clipped on the trailing end portion 326 of the absorbent material 316 such that the trailing end portion 326 passes through an opening 344 in the rear harness 320. In the preferred embodiment, the rear harness 320 is expandable so that it expands with expansion of the absorbent material 316. To accomplish this, the rear harness 320 has a split ring configuration created by a slot 321. The rear harness 320 may also include a guide 346 sized to accommodate a vent tube 348 extending therethrough.

Once the harnesses 318, 320 have been connected to the absorbent material 316, those portions of the absorbent material assembly 306 can be inserted into the cavity 312 with the vent tube 348 already inserted through the guide 346 and positioned within the cavity 312. The vent tube 348 may have a distal end portion 350 spaced from the blocking wall 342 to allow airflow from within the cavity 312, pass through the vent tube 348, and exit through a proximal end 352 of the vent tube 348. The end cap 308 may be assembled by pressing an end wall 354 into an opening of the end cap 308 until the end wall 354 snaps past a reduced diameter collar 356 in the end cap 308, as shown in FIG. 9. The engagement between the collar 356 and the end wall 354 may hold the end wall 354 within the end cap 308. This engagement, however, may permit the end wall 354 to rotate within the end cap 308. This functionality may permit an opening 358 in the end wall 354 to be passed over the proximal end 352 of the vent tube 348 when the end cap 308 is connected to the threaded end 310 of the body 302. Stated differently, as the end cap 308 is threaded onto the threaded end 310, the vent tube 348 extending through the end wall 354 may keep the end wall 354 stationary while the end cap 308 is threaded onto the body 302. Further, the proximal end 352 of the vent tube 348 may extend through the opening 358 in the end wall 354 and into a vent chamber 360 defined by the end wall 354 and the end cap 308. In this manner, the vent tube 348 may permit air injected with brushing by-products through input port 343 to pass through the vent tube 348, into the vent chamber 360, and into the atmosphere via openings 364 in the end cap 308.

It will be understood that various changes in the details, materials, and arrangements of parts and components which have been herein described and illustrated in order to explain the nature of the toothbrush device may be made by those skilled in the art within the principle and scope of the toothbrush device as expressed in the appended claims. Furthermore, while various features have been described with regard to a particular embodiment or a particular approach, it will be appreciated that features described for one embodiment also may be incorporated with the other described embodiments.

What is claimed is:

1. An oral care device comprising:

a body;

a reservoir of the body sized to hold an oral care product;

a discharge port in communication with the reservoir, the discharge port configured to discharge the oral care product from the reservoir;

a cavity of the body; and an input port in communication with the cavity, the input port permitting oral care byproducts to pass into the cavity and restricting passage of the oral care byproducts outward from the cavity.

2. The oral care device of claim 1 wherein the reservoir has at least a portion thereof disposed within the cavity.

3. The oral care device of claim 1 wherein the discharge port has a removable cover extending over the discharge port.

4. The oral care device of claim 1 wherein the input port is a one-way input port.

5. The oral care device of claim 1 wherein the reservoir includes a suction-drawn piston configured to be drawn toward the discharge port in response to suction being applied to the discharge port.

6. The oral care device of claim 1 further comprising an absorbent material within the cavity.

7. The oral care device of claim 6 further comprising a blocking wall in the cavity between the input port and the absorbent material.

8. The oral care device of claim 1 wherein the body includes an elongated handle.

9. The oral care device of claim 1 further comprising an oral care element carried on the body.

10. The oral care device of claim 9 wherein the oral care element includes at least one of a toothpick and a plurality of bristles.

11. An oral care device comprising:

a body;

a cavity of the body; and a one-way input port of the body in communication with the cavity, the input port permitting oral care byproducts to pass into the cavity and restricting passage of the oral care byproducts outward from the cavity.

12. The oral care device of claim 11 wherein the body includes an air vent in communication with the cavity, the air vent configured to permit airflow accompanying the oral care byproducts to flow outward from the cavity.

13. The oral care device of claim 12 wherein the air vent includes a through opening of the body and a tube having an end portion extending in the cavity and an opposite end portion disposed at the body through opening.

14. The oral care device of claim 11 wherein the body includes an air vent in communication with the cavity; and a blocking wall in the cavity between the input port and the air vent.

15. The oral care device of claim 11 further comprising an absorbent material in the cavity.

16. The oral care device of claim 15 wherein the body has an outer portion defining a section of the cavity; and at least one elevation member extends between the outer portion and the absorbent material to elevate at least a portion of the absorbent material a distance above the outer portion.

17. The oral care device of claim 16 wherein the absorbent material has a leading end portion adjacent the input port and a trailing end portion spaced from the input port, the at least one elevation member elevating the leading end portion of the absorbent material a distance above the body outer portion that is greater than a distance between the trailing end portion of the absorbent material and the body outer portion.

18. The oral care device of claim 11 further comprising an oral care element carried on the body.

19. The oral care device of claim 18 wherein the oral care element includes at least one of a toothpick and a plurality of bristles.

20. The oral care device of claim 11 wherein the body includes an elongated handle.

21. An oral care device comprising:

a body;

a cavity of the body;

a reservoir having at least a portion thereof disposed in the cavity of the body, the reservoir configured to hold an oral care product;

a discharge port in communication with the reservoir, the discharge port configured to discharge the oral care product from the reservoir; and a suction-drawn piston of the reservoir configured to be drawn toward the discharge port in response to suction being applied to the discharge port.

22. The oral care device of claim 21 wherein the reservoir includes a tube with the piston being disposed in the tube and configured to be drawn toward the discharge port along the tube as oral care product is discharged from the reservoir.

23. The oral care device of claim 21 wherein the discharge port includes a mouthpiece extending from the body.

24. The oral care device of claim 21 further comprising a cover extending over the discharge port.

25. The oral care device of claim 21 further comprising a plurality of bristles carried on the body;

the discharge port includes a tube having an open end surrounded by the plurality of bristles; and toothpaste disposed on the plurality of bristles covers the open end of the tube.

26. The oral care device of claim 21 further comprising an oral care element carried on the body.

27. The oral care device of claim 26 wherein the oral care element includes at least one of a toothpick and a plurality of bristles.

28. The oral care device of claim 21 wherein the body includes an elongated handle and a head connected to the handle.

* * * * *